US006041728A

United States Patent [19]

Goldstein et al.

[11] Patent Number: 6,041,728

[45] Date of Patent: Mar. 28, 2000

[54] SHAPE MEMORY ACTUATOR SYSTEM

[75] Inventors: David Goldstein, Potomac, Md.; Thang Dinh Nguyen, McLean, Va.

[73] Assignee: The United States of America as represented by the Secretary of the Navy, Washington, D.C.

[21] Appl. No.: 09/126,859

[22] Filed: Jul. 31, 1998

[51] Int. Cl.[7] ..... C22C 43/00; B63G 8/14; B63H 25/06

[52] U.S. Cl. ..... 114/162; 114/330; 148/402

[58] Field of Search ..... 114/330, 285, 114/162, 164; 148/402; 420/902

[56] References Cited

U.S. PATENT DOCUMENTS 4,010,455 3/1977 Stange ..... 340/224
5,114,104 5/1992 Cincotta et al. ..... 244/219
5,419,788 5/1995 Thoma et al. ..... 148/402
5,661,259 8/1997 Cipolla ..... 114/23

*Primary Examiner*—D. Glenn Dayoan
*Assistant Examiner*—Patrick Craig Muldoon
*Attorney, Agent, or Firm*—John Forrest; Jacob Shuster

[57] ABSTRACT

A control tab on a submarine or the like is angularly displaced by a remote control actuator system featuring a pair of shape-memory cables consisting of a superelastic actuating cable connected to the control tab and a force generating thermoelastic cable anchored to the submarine frame. A force transmitting lever interconnects the cables and is selectively locked by a releasable locking mechanism in a position holding the actuating cable fully stretched with the control tab displaced a maximum amount from its neutral position by the displacing force generated in the thermoelastic cable in response to heating thereof by electric current conducted therethrough.

17 Claims, 2 Drawing Sheets

SHAPE MEMORY ACTUATOR SYSTEM

The present invention relates in general to the displacement of an operational control element through an actuator cable having shape memory properties.

BACKGROUND OF THE INVENTION

The provision of additional operational control elements, such as control tabs installed at the trailing edge of the sternplanes on a submarine, has heretofore been considered in order to improve operational performance of the submarine with respect to sternplane jam recovery, and low and high speed maneuvering of the submarine. Such hydrodynamic control tabs are analogous to use of trim tabs on airfoils such as aircraft wings. However, use of such additional control tabs involved certain problems such as installational space requirements for the associated remote control actuator system, and generation of structural noise. The advantage in utilizing shape-memory cables made of Nitinol for size reduction of the remote control actuator system is well suited for a submarine environment because of its non-magnetic and corrosion resistance properties. Use of thermoelastic Nitinol introduces other problems because of the cooling and resetting properties of Nitinol cables. It is therefore an important object of the present invention to provide a shape-memory type of actuator system for remote control of control tabs or the like on structures such as submarines despite the problems associated therewith, without excessive expansion of required installational space or generation of electrical motor noise.

SUMMARY OF THE INVENTION

In accordance with the present invention, a pivotally mounted trailing-edge control tab on a hydrodynamic foil such as the sternplane of a submarine is remotely controlled through a supereleastic type of Nitinol actuating cable which undergoes stretching or elongation during pivotal displacement of the tab by a maximized amount in response to a displacing force transferred to the cable through linkage means in the form of a pivot bar lever pivotally mounted within the submarine or within the sternplane itself in spaced relation to the control tab being remotely controlled. When the superelastic cable is stretched by pivotal displacement of the tab, loading is transferred therefrom through the pivot bar lever to a thermoelastic cable within which the displacing force is generated. Such transfer of loading is interrupted and loading is maintained by locking of the pivot bar lever through a releasable locking mechanism in a position holding the superelastic actuating cable in its fully stretched condition. The thermoelastic cable is anchored to the submarine frame at one end opposite its end connected to the pivot bar lever. Between its ends such thermoelastic cable extends through a heat exchanger within which the cable is intermittently heated by electrical current conducted therethrough causing cable contraction for force generating purposes. The thermoelastic cable is cooled by water between intervals of heating to enable the aforesaid unloading action of the locking mechanism on the pivot bar lever. Release of the locking mechanism after cooling allows the cooled thermoelastic cable to stretch while also allowing the control tab to return to its neutral position from the position of maximum displacement during contraction of the actuating cable.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
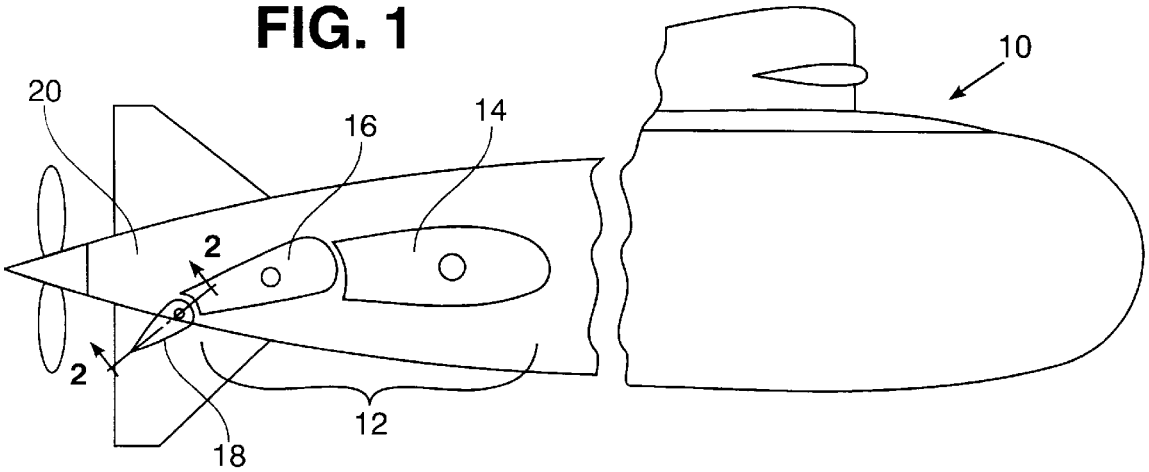
FIG. 1 is a partial side elevation view of a submarine having a sternplane on which a trailing edge control tab is mounted for remote control in accordance with one embodiment of the invention.

Referring now to the drawing in detail, FIG. 1 illustrates a submarine 10 of a generally known construction, mounting a standard type of hydrodynamic sternplane arrangement 12 through which depth change and depth maintenance of the submarine within seawater is controlled by pivotal displacement of the primary surface control element 16 at the trailing end of the sternplane stabilizer 14. Such control through the sternplane arrangement is performed by a hydraulic system within the submarine. However, in accordance with the present invention an additional operational control element is introduced in the form of a pivotally displaceable trim control tab 18 installed at the trailing edge of the sternplane arrangement 12 so as to improve vessel performance with respect to sternplane jam recovery, low and high speed maneuvering and provide other benefits such as a reduction in structural noises and use of a smaller hydraulic control system. Such additional control involving pivotal displacement of the trim tab 18 about its pivot 22, is effected by a remote control system 24 as schematically shown in FIG. 2 and diagrammed in FIG. 3.

Figure 2:
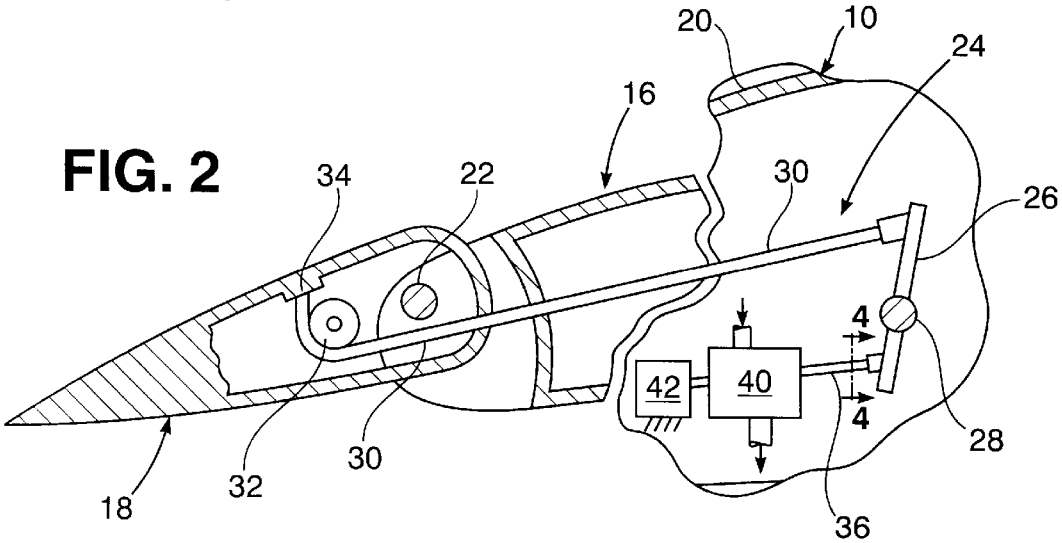
FIG. 2 is an enlarged partial section view taken substantially through a plane indicated by section line 2—2 in FIG. 1 showing portions of the remote control actuator system of the present invention.

The remote control system 24 includes force transmitting linkage means in the form of a pivot bar lever 26 pivotally mounted within the submarine for displacement about a pivot axis fixed to the submarine hull at pivot point 28 as shown in FIG. 2. A tab actuating cable 30 made of superelastic wires is connected to one end of the pivot bar 26 and extends therefrom without directional change through the sternplane components into the tab 18 to a pulley 32 therein, from which the cable 30 undergoes directional change for attachment at an interior location 34 to the tab 18. The other end of the pivot bar 26 is connected to one end of a thermoelastic wire cable 36 anchored at its other end to a fixed plate 38 within the submarine in spaced adjacency to a water cooling tank 44 as diagrammed in FIG. 3. The fixedly anchored cable 36 extends through an electrically operated heat exchanger 40 of a generally known type. Such heat exchanger 40 is connected to a programmed power supply 42 through which the cable 36 is controllably heated within the heat exchanger 40 and cooled by water from the tank 44 to which warmed water is returned from the heat exchanger.

Figure 3:
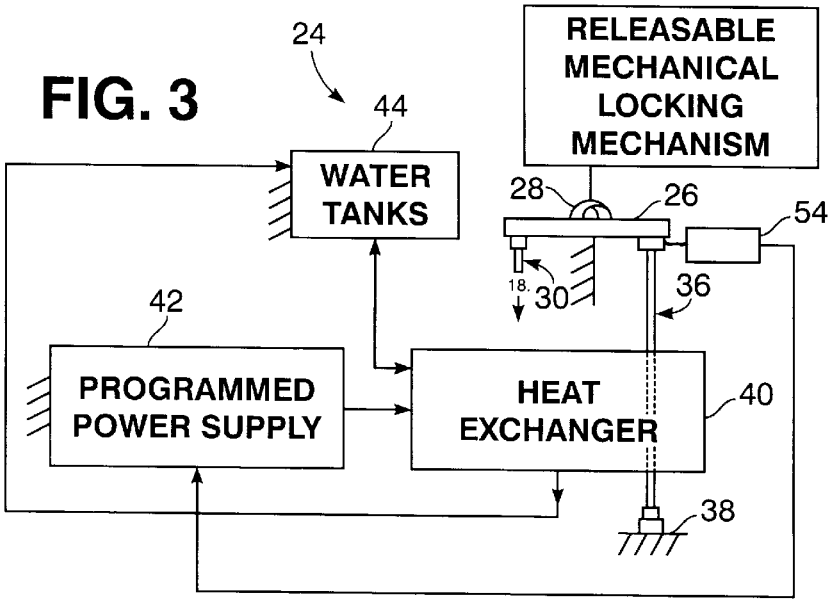
FIG. 3 is a schematic block diagram of the actuator system partially shown in FIG. 2.
Figure 5:
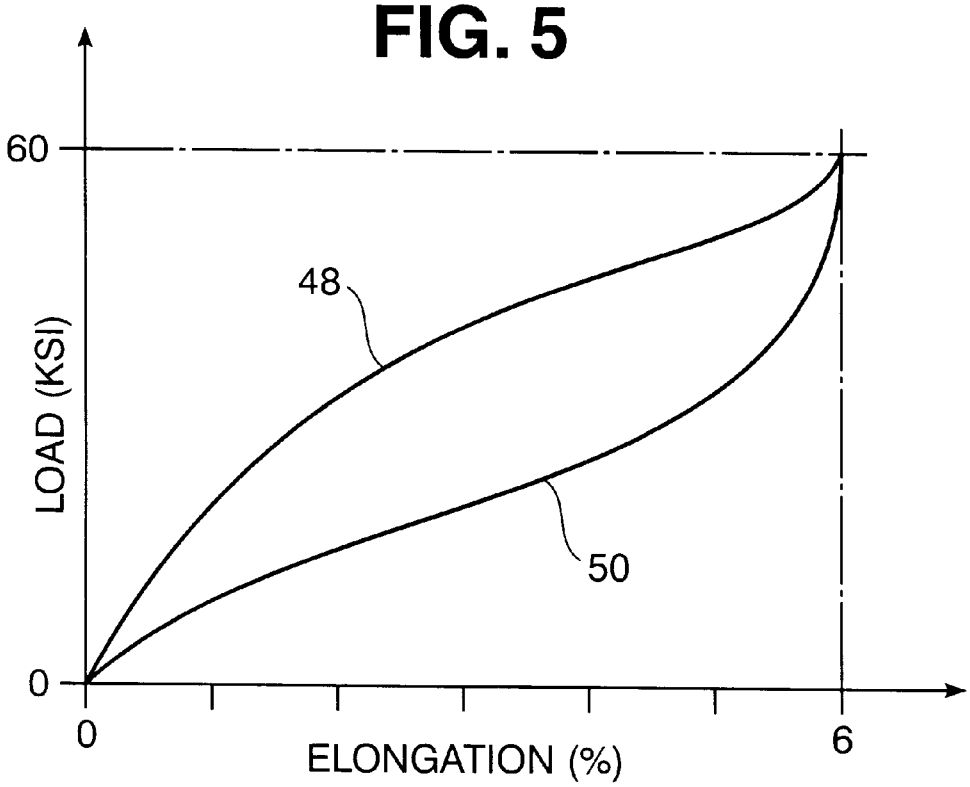
FIG. 5 is a graphical illustration of superelastic characteristics of the actuator cable associated with the actuator system shown in FIGS. 2 and 3.

FIG. 3 also diagrams a releasable mechanical locking mechanism 46 at the pivot point 28, operative to hold the pivot bar 26 in a position to which it is angularly displaced by cable 36 while under the loading of actuating cable 30. The superelastic alloy wire material from which cable 30 is made, is such that it undergoes elongation up to 6% when stressed by a force up to 100,000 lbs per square inch as reflected by curve 48 in FIG. 5 and contracts from such elongated state as reflected by curve 50. Degradation of elongation of cable 30 due to cyclic loading and unloading imposed through elongation and contraction of cable 36 is avoided. Such relationship of load elongation for cable 30 to operation of system 24 is made possible by the characteristic of the superelastic alloy of cable 30 and the mechanical locking of pivot bar 26 in the fully stretched condition of cable 30 to thereby unload the other cable 36.

Movement is controllably imparted to the control tab 18 through cable 30 by heating and cooling of the cable 36, made of thermoelastic wire such as Nitinol, requiring less than 30 Ksi to stretch while capable of exerting up to 100,000 lbs per square inch by contraction in response to electrical resistance (joule) heating within the heat exchanger 40. A tab displacement force of up to 8000 lbs generated by heat responsive phase transformation of cable 36, is transmitted through the pivot bar 26 to the cable 30 for pivotal displacement of the tab 18 through a maximum desired angle about its pivot 22. The foregoing shape-memory contracting action of cable 36 in the described installation involves about 4% elongation recovery, associated with cyclically controlled inflow and outflow of cooling water to the heat exchanger 40 of system 24.

As hereinbefore indicated, the tab 18 is angularly displaced from its neutral position by heat induced contraction of cable 36 generating a tab displacing force applied through the pivot bar 26 to cable 30 so as to cause its elongation while transmitting the displacing force to the tab until the cable 30 is fully stretched, whereupon the pivot bar 26 is locked in position by mechanism 46 so as to hold cable 30 fully stretched and unload the cable 36. The locking mechanism 46 may then be selectively released so as to enable contraction of cable 30 due to its superelasticity as reflected by curve 50 in FIG. 5. The cable 36 is thereby stretched after being cooled, allowing the tab 18 to return to its neural position with the locking mechanism released.

Figure 4:
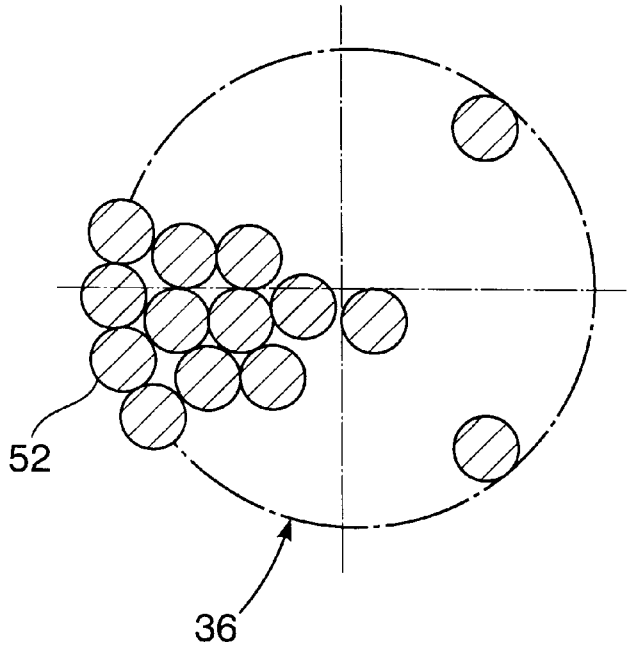
FIG. 4 is a partial transverse section view of the thermoelastic cable of the actuator system taken substantially through a plane indicated by section line 4—4 in FIG. 2.

As shown in FIG. 4, the cable 36 according to the illustrated embodiment includes a plurality of individual Nitinol wires 52 which are electrically interconnected in parallel within the heat exchanger 40 for simultaneous electrical heating of the cable above its transformation temperature of 100° C. so as to generate a cable contraction stress of 60,000 lbs per square inch during its shape-memory transformation as aforementioned. A total cross-sectional area of ⅛ square inch for the cable 36 necessary for such transformation action is formed by 45 wires 52 having 0.060 inch diameters. The non-magnetic, corrosion resistance properties of Nitinol from which the wires 52 are made are well suited to the cable usage hereinbefore described within the submarine environment. As to the cable 30, it is also formed from a plurality of wires made from pseudoelastic alloys having superelasticity properties. Such wires may be braided or twisted to provide the necessary flexibility within a ⅛ square inch cross-sectional area for the cable 30 with which no thermal actuation is associated as in the case of cable 36. The cable 30 moves the tab 18 only after it undergoes a change in stress.

FIG. 3 also diagrams a measuring device 54 at the end of pivot bar 26 to which the cable 36 is attached, so as to measure pivot bar displacement and supply a measurement signal to an electronic circuit in the power supply 42 for adjustment thereof so as to achieve the desired intermittent contraction of the cable 36 by electrical heating within the heat exchanger 40. Such heating is accomplished by the adjusted supply of electrical current in parallel to the cable wires 52 acting as resistors. Cooling of the cable 36, on the other hand, is achieved by its submergence with water maintained close to ambient temperature by intermittent circulation to and from the water tanks 44.

The remote control system 24 hereinbefore described is effective to impart angular displacement to tab 18 in one direction from its neutral position. (downwardly as viewed in FIGS. 1 and 2). It is therefore contemplated that at least one additional control system similar to that of system 24 may be employed by attachment to the tab for pivotal displacement thereof from the neutral position in the opposite direction (upwardly).

Obviously, other modifications and variations of the present invention may be possible in light of the foregoing teachings. It is therefore to be understood that within the scope of the appended claims the invention may be practiced otherwise than as specifically described.

What is claimed is:

1. A shape-memory actuator system for displacement of an operational element mounted on a structure, including: a deformable cable anchored to said structure; an actuating cable connected to the operational element; selectively controlled means intermittently heating the deformable cable anchored to the structure for causing elongation and contraction thereof to generate therein a displacing force; and linkage means operatively interconnecting the cables for transmission of said displacing force through the actuating cable to the operational element causing said displacement thereof while the actuating cable undergoes elongation.

2. The system as defined in claim 1, wherein said structure is a submarine and the operational element is a control tab undergoing said displacement by a maximum amount in response to said displacing force.

3. The system as defined in claim 2, wherein said linkage means comprises:

a pivot bar having opposite end portions respectively connected to the cables and an intermediate pivotal axis fixed to the structure about which the pivot bar undergoes angular movement in response to said displacing force.

4. The system as defined in claim 3, including releasable locking means for preventing said angular movement of the pivot bar after said displacement of the control tab by said maximum amount.

5. The system as defined in claim 4, wherein said selectively controlled means intermittently heating the deformable cable anchored to the structure includes: programmed power supply means for conducting electrical current through the deformable cable acting as an electrical resistor; and water cooling means through which the deformable cable extends for absorbing heat electrically generated by the electrical current conducted through the deformable cable.

6. The system as defined in claim 5, wherein each of said cables are formed from a plurality of electrically conductive wires made of a shape-memory material.

7. The system as defined in claim 1, wherein said linkage means comprises: a pivot bar having opposite end portions respectively connected to the cables and an intermediate pivotal axis fixed to the structure about which the pivot bar undergoes angular movement in response to said displacing force.

8. The system as defined in claim 1, including releasable locking means for preventing said angular movement of the pivot bar by the operational element through the actuating cable when displaced by a maximum amount.

9. The system as defined in claim 1, wherein said selectively controlled means intermittently heating the deformable cable anchored to the structure includes: programmed power supply means for conducting electrical current through the deformable cable acting as an electrical resistor; and water cooling means through which the deformable cable extends for absorbing heat electrically generated by the electrical current conducted through the deformable cable.

10. The system as defined in claim 1, wherein each of said cables is formed from a plurality of electrically conductive wires made of a shape-memory material.

11. A shape-memory actuator system for displacement of an operational element mounted on a structure, including: a deformable cable anchored to said structure; an actuating cable connected to the operational element; programmed power supply means intermittently conducting electrical current through the deformable cable anchored to the structure for heating thereof to generate a displacing force; and lever means pivotally mounted on the structure and operatively interconnecting the cables for transmitting the displacing force through the actuating cable to the operational element.

12. The system as defined in claim 11, wherein each of said cables is formed from a plurality of electrically conductive wires made of a shape-memory material.

13. The system as defined in claim 12, including releasable locking means for preventing angular movement of the lever means and transfer of loading between the cables when the operational element undergoes said displacement by a maximum amount.

14. The system as defined in claim 13, wherein said structure is a submarine and the operational element is a control tab undergoing said displacement to the maximum amount in response to said displacing force.

15. The system as defined in claim 11, wherein said structure is a submarine and the operational element is a control tab undergoing said displacement by a maximum amount in response to said displacing force.

16. An actuator system for displacement of an operational element on a structure from a neutral position, including: a superelastic actuating cable connected to the operational element; means for generating a displacing force; linkage means operatively connecting the force generating means to the actuating cable for transfer of the displacing force thereto causing elongation thereof while imparting said displacement to the operational element; and releasable locking means operatively connected to the linkage means for interrupting said transfer of the displacing force to unload the force generating means and enable contraction of the actuating cable during return of the operational element to the neutral position.

17. The actuator system as defined in claim 16 wherein the force generating means includes: a thermoelastic cable anchored to the structure and connected to the linkage means; and means conducting electrical current through the thermoelastic cable for intermittent electrical heating thereof to produce said displacing force in response to contraction of the thermoelastic cable.

* * * * *